US005455750A

United States Patent [19]

Davis et al.

[11] Patent Number: 5,455,750

[45] Date of Patent: Oct. 3, 1995

[54] ARTIFICIAL CHRISTMAS TREE WITH SCENT, SOUND AND VISUAL ELEMENTS INCORPORATED THEREIN

[76] Inventors: Lewis W. Davis, P.O. Box 523; Francis A. Rogers, 508 N. 7th St., both of Holbrook, Ariz. 86025

[21] Appl. No.: 152,323

[22] Filed: Nov. 15, 1993

[51] Int. Cl.[6] ..... A47G 33/06

[52] U.S. Cl. ..... 362/123; 428/18

[58] Field of Search ..... 428/18, 19, 20; 362/123

[56] References Cited

U.S. PATENT DOCUMENTS

| | | | |
|---|---|---|---|
| 3,118,617 | 1/1964 | Hellrich | 428/18 X |
| 3,206,593 | 9/1965 | Winnicki, Sr. | 428/18 X |
| 3,296,430 | 1/1967 | Eckert | 428/20 X |
| 3,571,586 | 3/1971 | Duckworth | 428/19 X |
| 3,614,528 | 10/1971 | Craddock | 428/18 X |
| 3,617,732 | 11/1971 | Fischer | 428/18 X |
| 3,735,116 | 5/1973 | Morrison | 362/226 |
| 3,735,117 | 5/1973 | Hunt | 428/18 X |
| 4,573,102 | 2/1986 | Norwood | 362/123 |
| 5,025,962 | 6/1991 | Renfro | 428/18 X |
| 5,103,380 | 4/1992 | Lindner et al. | 428/18 X |
| 5,213,407 | 5/1993 | Eisenbraun | 428/18 X |
| 5,279,871 | 1/1994 | Segan et al. | 428/18 |
| 5,280,682 | 1/1994 | Fussell | 362/123 X |

*Primary Examiner*—Henry F. Epstein
*Attorney, Agent, or Firm*—Christopher Klein

[57] ABSTRACT

An artificial holiday tree arrangement is disclosed herein which incorporates different elements associated with the Christmas season. The arrangement is comprised of an artificial Christmas tree, which incorporates a scent producing element therein, as well as an illuminated tree-top ornament, all electrically connected to an electric current producing means. Optionally, the arrangement can also incorporate a sound producing means in the tree trunk body or the tree support, to supply holiday music. All the elements of the holiday tree arrangement are connected to and controlled by a control box attached thereto.

16 Claims, 2 Drawing Sheets

SCENT BOX
TREE TOP OR CROWN
ODD LIMBS
EVEN LIMBS
SB
NO
NC
P1
P2
P3
FLASHER
TO 110VAC
+12VDC
12VDC CONVERTER & TREE CONTROL STATION

ARTIFICIAL CHRISTMAS TREE WITH SCENT, SOUND AND VISUAL ELEMENTS INCORPORATED THEREIN

BACKGROUND OF THE INVENTION

1. Field of the Invention

This invention relates to artificial trees and, more particularly, to an artificial Christmas tree incorporating therein several elements such as sound, scent and visual holiday displays.

2. Description of the Prior Art

Electronically illuminated artificial trees have been well known in the art for a long period of time and are particularly popular during the Christmas holiday season in many developed areas of the world. Normally, one can purchase an artificial Christmas tree that already has decorative lights incorporated therein, or a plain artificial Christmas tree and decorate said tree with lights and other decorations. Representative of the well known artificial Christmas trees are those described in U.S. Pat. Nos. 3,118,617; 3,206,593; 3,296,430; 3,571,586; 3,617,732; and 4,573,102 incorporated herein by reference.

In addition to the Christmas tree and decorations and lights thereon, persons celebrating the holiday ordinarily decorate the surrounding area with numerous other holiday related items. These items can include a manger or Holy scene, incense or potpourri burners which are heated by fire (e.g., candles) or electricity, and even holiday music to complete the festive mood. There are, however, several obvious drawbacks to having all of these decorative items. First, there is an increased cost for every time one must purchase another item to decorate a given area. Second, with all the several decorative and holiday items used around the holidays, they often create a crowded and uncomfortable area in which to relax or entertain. This is especially so in small or studio apartments. Finally, with all these items in one crowded place, often there exists a fire or electric hazard from the numerous required electric cords and candles. Obviously, and as we have all experienced, creating the desired holiday atmosphere around the Christmas season takes alot of time, money and space.

SUMMARY OF THE INVENTION

In overcoming the aforementioned problems and drawbacks encountered during holiday decorating, the present invention provides a unique and novel combination of holiday elements which is easily assembled, contains all the desired decorative aspects in one central area, and is easily controlled by a manual control box connected to the tree via a wire connection, or optionally by remote control.

A primary objective of the present invention is to provide a novel artificial Christmas tree, wired to carry electricity to illuminate the tree and power additional elements, said tree incorporating therein in its trunk portion a container heated by a heating element to heat incense or other scent producing products, and incorporated at the top of the tree an illuminated tree-top visual display element. Said combination of scent and visual elements can be powered by an electricity producing means attached to or incorporated into the base of tree or tree support.

Another object of the present invention is to provide a tree as described above, additionally incorporating therein a sound producing element such as a tape player, compact disc player, digital audio tape player, digital disc player, or radio frequency receiver. Said audio producing element is connected to the electronic wiring incorporated throughout the tree and is powered by the electricity producing means connected to or incorporated into the base of the tree.

A still further object of the present invention is to provide an artificial tree as described above, with said tree elements controlled manually by a control box connected to said tree via wires and electrically connected to said scent, audio and visual elements, or alternatively controlled by a remote sensor incorporated in said control box and adjusted by a manually held remote control.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure.

In accordance with these and other objects of the present invention, an embodiment is herewith disclosed and includes an artificial Christmas tree internally wired for electricity, said tree comprising a trunk body member extending the length of the tree, having a tree-top receiving means positioned at the top of said trunk body and a tree-top visual display element having a connecting means to connect in a physical and electrical engagement therewith, and said trunk body having a plurality of branch receiving means positioned thereon and a plurality of tree branches having connecting means to connect in a physical and electric engagement therewith. The tree branches are further provided with a plurality of illuminating members and leaf members with a means for electrically connecting the illuminating members to the connecting means, Also incorporated in said trunk, at a position at or near the bottom of said trunk, is a means for containing incense or other scent producing material, said containing means heated by a heating means incorporated therewith. Optionally, in an embodiment of the invention, a sound producing element is incorporated in the trunk body or a tree support. A support means is also provided for supporting the trunk body member and has a means for supplying electric current, and a means for electrically connecting the branch receiving means, the container heating means, the audio producing means, and the tree-top illuminated visual display to the means for supplying electrical current. A control means, connected to said support means, is also provided to give the viewer control over light display, the scent producing means, the sound means, and/or the tree-top visual display.

DETAILED DESCRIPTION OF A PREFERRED EMBODIMENT

Figure 1:
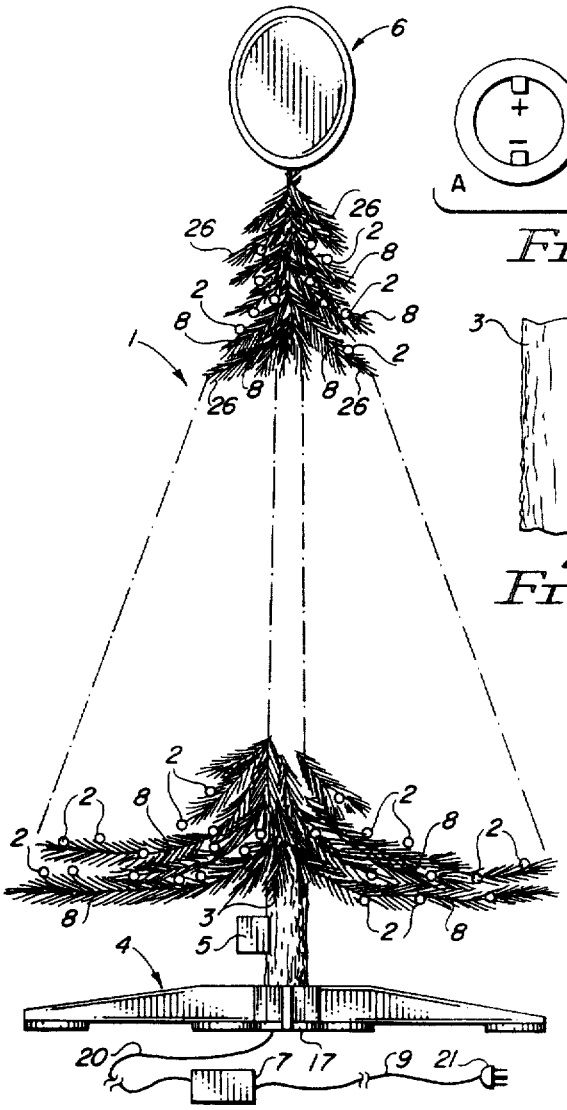
FIG. 1 depicts an embodiment of the present invention with the novel combination of tree, lights, scent box and tree-top illuminated holiday scene.
Figure 3:
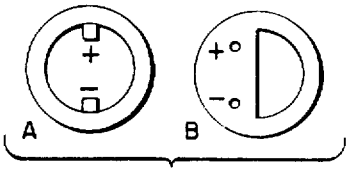
FIG. 3 gives two possible formats (A and B) for the female (receiving) end of trunk, branch and tree-top receiving means.

Referring now in detail to FIGS. 1 through 7, there is shown an electrically illuminated holiday tree 1, according to the teachings of the present invention, wherein the tree 1 includes a trunk body member 3 having a support means 4 attached at the bottom thereof. The support means 4 consists of a central base 17 having a means for supplying electrical current 20 to the tree 1. This means for supplying 20 includes adequate wiring 9 and a male wall outlet plug 21 which can be plugged into any conventional wall outlet (not shown). The electricity flowing from the wall outlet via outlet plug 21, and through electrical wire 9, is passed through and controlled by control box 7. In order to provide low voltage to the tree 1, a transformer of a type generally known in the art may be positioned within the base 17 of the support means 4 to step down the voltage of the incoming household current from the wall outlet (not shown) to a relatively low voltage. Alternatively, a transformer of a type known in the art may be positioned in control box 7 to step down the voltage of the incoming household current to a relatively low voltage to be supplied to tree 1 via supplying wire 20.

Figure 4:
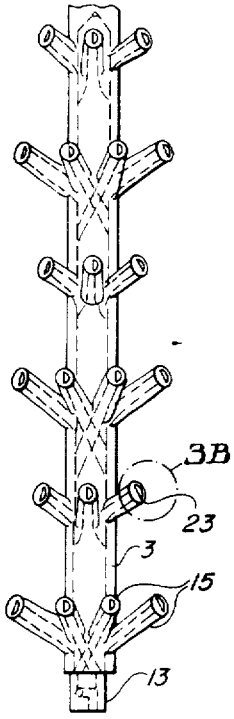
FIG. 4 shows a close up view of a section of the trunk without the branches.

The trunk body member 3 is further provided with a plurality of branch receiving means 15, as particularly shown in FIG. 4, which are positioned in an angled relationship to the trunk body member 3. Branches 8 are provided, each having an inward end that is connected to branch receiving means 15 and an outward end extending outwardly from trunk body 3. When inserted into the branch receiving means 15, the branches 8 project radially outwardly and axially upwardly from the trunk 3 and are preferably covered with artificial needles 26 so as to resemble a real tree. Depending upon the type of tree desired, said artificial needles may be, but are not limited to, those which resemble blue spruce tree, green spruce tree, or white to resemble frost on the needles. Additionally, the branches 8 are preferably of various lengths with the longest disposed adjacent to the base end of trunk 3 and the shortest disposed adjacent to the top of trunk 3. Tree branches 8 are also provided with electrically insulated wires throughout, which are the means for electrically connecting tree lights 2 to the electricity producing means 20. Tree lights 2 can be of any acceptable type used in the art, for example, but not limited to Westinghouse W-194 lights. Branch lights 2 may optionally include a colored outer surface for coloring the light emitted therefrom. Branch lights 2 can be connected to electric wires dispersed in branches 8 by a variety of well known configurations, but are preferably connected in series and in such a manner so as to allow electrical current to flow throughout branch 8 when one or more branch lights 2 have been damaged or disconnected. The trunk and branches may be constructed of metal, wood or plastic and may be dimensioned to provide a tree of any desired height.

Tree support 4 is comprised of a central core 17, onto which is attached at least two stand legs 18. The legs 18 are preferably attached via a dove tail configuration contained in the leg connecting nip 19. Nip 19 is that part of the leg 18 which is inserted into a receiving means 34 located in central core 17.

Located in the central core 17 of tree support 4 is a female type trunk receiving means 22, into which the bottom section 13 of trunk body 3 is inserted. The trunk receiving means 22 contains a recess to provide an effective means for supporting the trunk body 3 inserted therein. Each of said branch receiving means 15 is also equipped with a female type receiving means 23, of the same configuration of trunk receiving means 22. The configuration of the trunk receiving means 22 and the branch receiving means 23 may be of the types shown in FIGS. 3A and 3B, or of the types as described in U.S. Pat. No. 4,573,102 incorporated herein by reference.

The bottom of trunk body 3 is equipped with a male plug 13, of the same configuration of male plug 16 located on each inward end of the branches 8. Male plug 13 on the bottom of trunk body 3 is designed to engage female trunk receiving means 22, and male plug 16 on the inward end of branches 8 is designed to engage female branch receiving means 23. The female receiving means 22 and 23 are also provided with a surface which restricts the orientation of trunk male plug 13 and branch male plug 16 relative to female receiving means 22 and 23 and inherently provides a safety precaution to prevent inappropriate insertion of other types of male plugs. The female receiving means 22 and 23 are further provided with a means for electrically connecting the central core 17 to the trunk body 3, and the branch receiving means 15 to the branches 8, thereby connecting the trunk body 3 and branches 8 to the electrical current provided at tree support 4. The means for supplying electrical current to the trunk body 3 and branches 8 is wires which are internally positioned in trunk body 3 and connect the branch receiving means 15 in series. The wires allow the current to flow from support base 4 through trunk body 3 to branch receiving means 15. An electrical and physical connection between trunk body 3 and the female receiving means 22 in the tree base 4 is provided upon full insertion of base male plug 13 of trunk body 3 into female receiving means 22. Likewise, an electrical and physical connection between branch receiving means 15 and branches 8 is provided upon full insertion of male plug 16 on the inward end of branches 8 into female receiving means 23. An electric design as that described in U.S. Pat. Nos. 3,571,586; 3,735,116; or 4,573,102 (incorporated herein by reference) may be utilized in the present invention. The trunk body 3 may be divided into two or more sections of equal or varying length to provide ease of storage and assembly. The sections of the trunk body 3 are then connected by a female receiving means and male plug similar to that described above for the connection between the branch receiving means 15 and the branches 8, and the tree support 4 and the base of trunk body 3.

The top of trunk body 3 is equipped with a tree-top female receiving means 24, similar in configuration to that described above for trunk female receiving means 22 and branch female receiving means 23. Into this female receiving means 24 is inserted a tree-top 25 which is comprised of tree-top male plug 27, tree-top shaft 35 and tree-top peak 6. Tree-top 25 may contain any of several possible holiday type ornaments or scenes in tree-top peak 6. The bottom or base portion of tree-top 25 is equipped with male plug 27, similar in configuration to male plug 16 as described above. An electric and physical connection is provided between trunk body 3 and tree-top 25 upon full insertion of male plug 27 into tree-top female receiving means 24. Tree-top 25 is wired so as to be connected to the electric current provided from tree base 4. Tree-top peak 6 is connected physically and electrically to tree-top shaft 35 via a means for providing electricity to tree-top peak 6. Tree-top peak 6 may then contain one or more lighting means to illuminate a holiday ornament or scene. Examples of such holiday ornaments or scenes may be, but are not limited to, a star, cr`eche scene, picture of Our Lord, a snowflake, or any other decoration associated with the holiday season. Alternatively, in another embodiment of the present invention, tree-top peak 6 may be physically and electrically connected to tree-top shaft 35 via a rotating motor 12 of a type typically found in the prior art. Rotating motor 12 would make it possible to have tree-top peak 6 rotate in a fashion to expose the holiday ornament or scene in tree-top peak 6 to the 360 degree area surrounding tree 1. Preferably, tree-top 6 would rotate at a speed of about 3–6 rotations per minute.

Figure 10A:
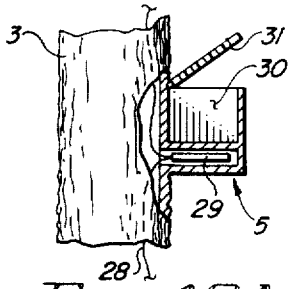
FIG. 10A shows a heating or scent box built into and continuous with the trunk body.
Figure 10B:
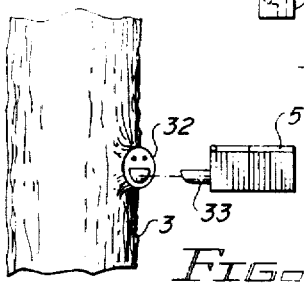
FIG. 10B shows a means for attaching a separate scent box to the trunk body.

The preferred embodiment of tree 1 also incorporates toward the bottom or base of trunk body 3, about 3–15 inches above tree support 4 depending on the total height of tree 1, a heating container or scent box 5. Scent box 5 is preferably built into and continuous with trunk body 3 (FIG. 10A), or may alternatively be attached to trunk body 3 (FIG. 10B) by a female scent box receiving means 32 located at a position to accept a male plug 33 on scent box 5. Scent box 5 contains a means 28 for carrying electric current and a means 29 for heating scent box 5. Means 28 for carrying electric current and means 29 for heating scent box 5 is comprised of electric wires connected to and dispersed throughout the bottom and/or sides of scent box 5. Said means 28 for carrying electric current is connected electrically to means 20 for supplying electric current to tree 1. Scent box 5 is preferably made of a ceramic heat resistant material, although other heat resistant materials known in the art may be used. Scent box 5 contains a recess 30 to accept scent producing pellets or potpourri, and a box cover 31, preferably containing holes to permit the scent of the heated pellets or potpourri to escape.

In still another embodiment of the present invention, trunk body 3 contains a sound producing means 10 at the base of the tree 1, above and attached to tree support 4. Sound producing means may be comprised of, but is not limited to, a magnetic tape player, compact disc player, digital tape player, digital disc player, or radio frequency receiving means, all found and available in the prior art. Said sound producing means 10 is electrically connected to electric current producing means 20, thereby supplying power to sound producing means 10. Sound producing means 10 may be built into and continuous with trunk body 3 and/or tree support 4, or may be separate and attached to trunk body 3 and/or tree support 4 via a receiving means.

Figure 8:
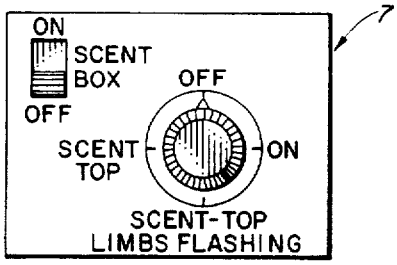
FIG. 8 is one example of controls on a control box.
Figure 5A:
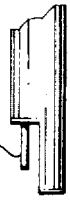
FIG. 5 shows a close up view of a branch section separated from the trunk.
Figure 5:
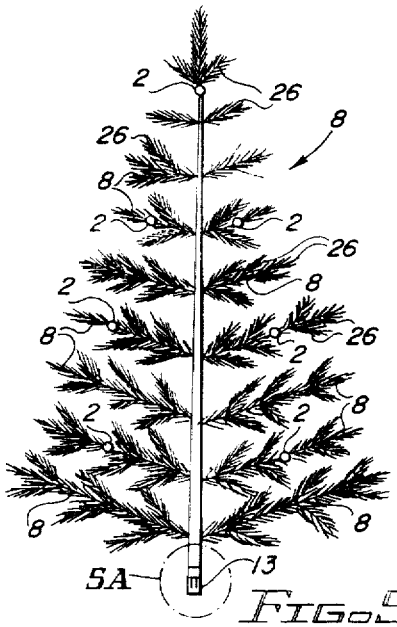
Figures 2, 2A, 6, 7, 9:
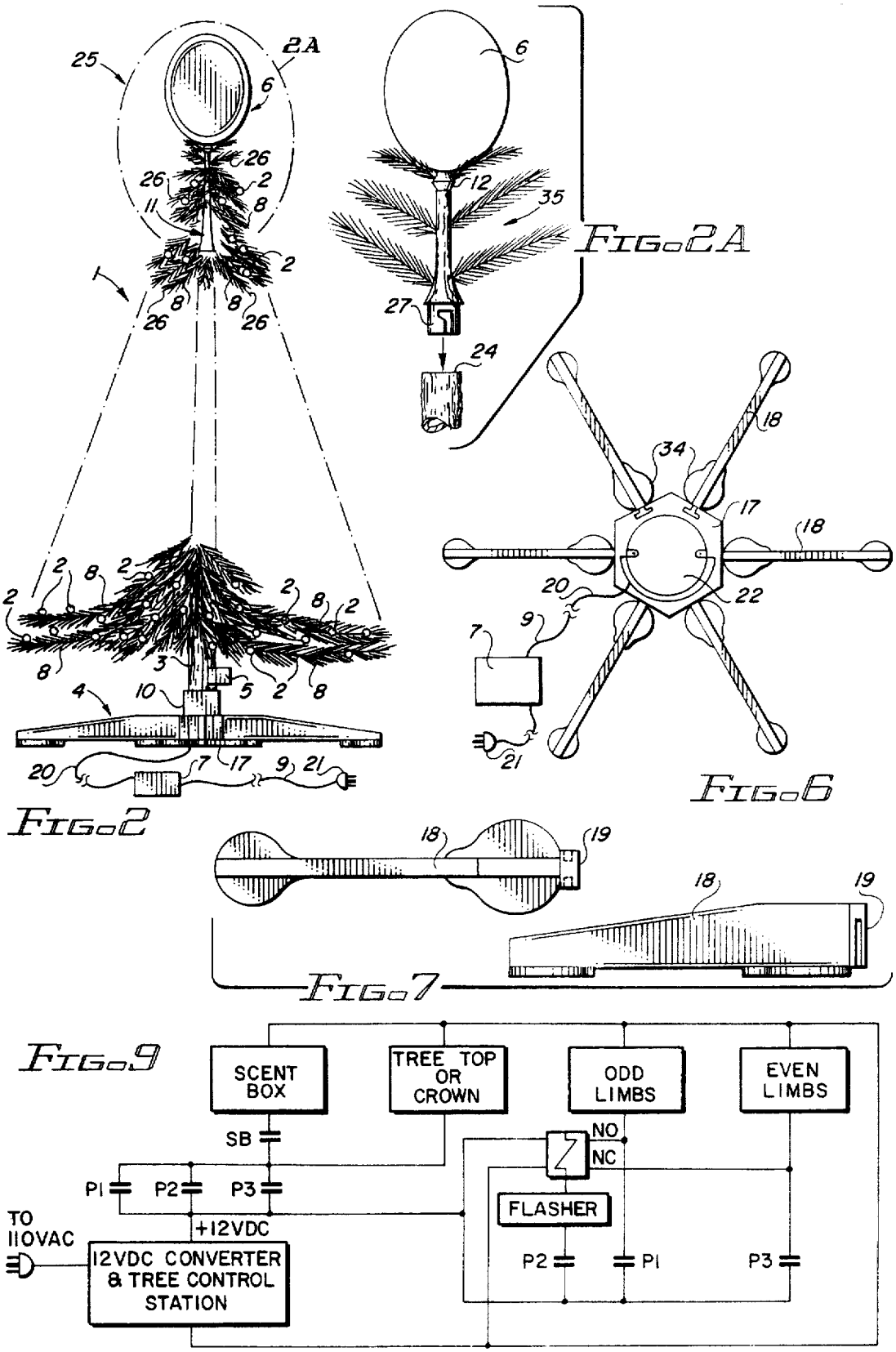
FIG. 2 depicts the tree with the leaves stripped away to disclose the entire trunk, with an enlarged view of the tree-top illuminated section.
FIG. 6 gives a top view of an empty tree support.
FIG. 7 gives a top view and a side view of the legs on tree support.
FIG. 9 is one example of a wiring diagram for electric current to reach all elements of the present invention.

All the electric features of tree 1 may be electrically attached to and controlled by control box 7. Control box 7 is separate from tree 1 and may be set on a table, stand or the ground. As described above, control box 7 may also contain a transformer to convert the electric current from the wall socket (not shown) to a lower voltage electricity usable in tree 1. Control box 7 may be provided with one or more control options to permit, for example, illumination of the scene or ornament in tree-top scene 6 only, or power to the heating means of scent box 5 only, or power to scent box 5 and branch lights 2 only, or any combination of elements. An example of one embodiment of control box 7 is shown in FIG. 8, wherein position 1 provides power to every circuit in tree 1; position 2 will provide power to scent box 5 and tree-top 25 while providing a current to the branch lights 2 to cause flashing of said lights; and position 3 provides power only to scent box 5 and tree-top 25. Other variations of control of scent box 5, sound producing means 10, branch lights 2 and tree-top 25 may be used. A sample wiring diagram to facilitate such control is provided in FIG. 9. Optionally, as depicted in FIG. 8, control box 7 may also contain a separate on/off switch for scent box 5. Additionally, using material and procedures well known in the art, control box 7 may be provided with a remote sensor to permit control of the various electronic options via remote control. This would permit greater freedom of movement about tree 1 while still maintaining control without having to remain by, and manually adjust, control box 7.

From the foregoing, it is apparent that the objects of the present invention have been fully accomplished. As a result of the present invention a new and improved electrically illuminated artificial tree arrangement that includes scent, sound and light elements has been disclosed. A preferred embodiment of the principles of this invention having been described and illustrated, it is to be realized that the same are not limited to the particular illuminated tree configuration shown in the drawings, and that modifications of thereof are contemplated and can be made without departing from the spirit and scope of this invention as defined by the following claims.

What is claimed is:

1. An improved artificial holiday tree arrangement comprising:

an artificial Christmas tree comprised of a trunk body member having a plurality of angularly recessed branch receiving means positioned thereon, a tree-top receiving means at the top thereof, a heating container with a heating element at a position at or near the bottom of said trunk body member, and a means for electrically connecting said heating element to said trunk body member;

a plurality of tree branches, each including a plurality of illuminating members and leaf members located at spaced intervals along the tree branches, a connecting means positioned at the inward end of said branches for electrically engaging said branch receiving means, and a means for electrically connecting said illuminating members to said connecting means;

a tree-top section separate from said trunk body member, containing a connecting means positioned at the bottom portion of said tree-top section for electrically engaging said tree-top receiving means on said trunk body member;

a support means having a means for supplying electrical current to said trunk body member and a means for electrically connecting said branch receiving means to said means for supplying electrical current, the means for electrically connecting including a plurality of insulated wires circuitously attached to the illuminating members, branch receiving means, tree-top receiving means, heating element, and the means for supplying electrical current; and a control box electrically connected to said means for supplying electrical current to said trunk body.

2. The artificial holiday tree arrangement of claim 1 wherein said leaf members resemble the leaf members of a blue spruce tree, a green spruce tree, or are white.

3. The artificial holiday tree arrangement of claim 1 wherein said tree-top section is comprised of a shaft section and a peak section, said peak section attached to said shaft section by a means to permit axial rotation about the tree-top shaft.

4. The artificial holiday tree arrangement of claim 3 wherein said means to permit axial rotation is comprised of an electrically driven motor.

5. The artificial holiday tree arrangement of claim 1 wherein said heating container at or near the bottom of said trunk body is comprised of a heat resistant material.

6. The artificial holiday tree arrangement of claim 1 wherein said heating container is built into and continuous with said trunk body.

7. The artificial holiday tree arrangement of claim 1 wherein said trunk body further contains a heating container receiving means to accept a heating container separate from said trunk body.

8. The artificial holiday tree arrangement of claim 1, further comprised of a sound producing means at or near the bottom of said trunk body, said sound producing means electrically connected to said means for supplying electrical current to said trunk body.

9. The artificial holiday tree arrangement of claim 8 wherein said sound producing means is selected from the group consisting of a magnetic tape player, compact disc player, digital tape player, digital disc player, and radio frequency receiver.

10. The artificial holiday tree arrangement of claim 1 wherein said control box is comprised of a manually adjusted control box.

11. The artificial holiday tree arrangement of claim 1 wherein said control box is comprised of a control box containing a remote frequency receiver controlled by a separate remote control.

12. The artificial holiday tree arrangement of claim 1 wherein said support means comprises a support member attached to an end of said trunk body member to provide support thereto.

13. The artificial holiday tree arrangement of claim 12 wherein said support means has a transformer disposed therein which is electrically connected to said means for supplying electrical current.

14. The artificial holiday tree arrangement of claim 1 wherein said control box has a transformer disposed therein which is electrically connected to said means for supplying electrical current.

15. The artificial holiday tree arrangement of claim 1 further comprised of a sound producing means incorporated into said support means, said sound producing means electrically connected to said means for supplying electrical current to said trunk body.

16. The artificial holiday tree arrangement of claim 1 wherein said sound producing means is selected from the group consisting of a magnetic tape player, compact disc player, digital tape player, digital disc player, and radio frequency receiver.

* * * * *